US006744209B2

(12) United States Patent
Jang et al.

(10) Patent No.: US 6,744,209 B2
(45) Date of Patent: Jun. 1, 2004

(54) MICROWAVE OVEN

(75) Inventors: Seong-Deog Jang, Suwon (KR); Dae-Sung Han, Hwasung (KR); Yong-Woon Han, Kunpo (KR); Han-Seong Kang, Suwon (KR); Kwang-Seok Kang, Suwon (KR)

(73) Assignee: Samsung Electronics Co, Ltd., Suwon-si (KR)

( * ) Notice: Subject to any disclaimer, the term of this patent is extended or adjusted under 35 U.S.C. 154(b) by 49 days.

(21) Appl. No.: 10/188,855

(22) Filed: Jul. 5, 2002

(65) Prior Publication Data

US 2003/0117077 A1 Jun. 26, 2003

(30) Foreign Application Priority Data

Dec. 24, 2001 (KR) ..... 2001-0084397

(51) Int. Cl.[7] ..... H01J 25/50; H05B 6/66

(52) U.S. Cl. ..... 315/39.51; 219/715; 219/702; 219/482

(58) Field of Search ..... 315/39.51, 39.63, 315/500, 502, 503, 39.53; 219/715, 702, 716, 717, 721, 482, 483, 736, 738, 678

(56) References Cited

U.S. PATENT DOCUMENTS

| | | | | | |
|---|---|---|---|---|---|
| 4,223,245 | A | * | 9/1980 | Ogura et al. | 315/39.51 |
| 5,300,744 | A | * | 4/1994 | Maehara et al. | 219/687 |
| 5,321,235 | A | * | 6/1994 | Makino et al. | 219/716 |
| 5,331,128 | A | * | 7/1994 | Koh | 219/717 |
| 5,977,530 | A | * | 11/1999 | Bessho et al. | 219/715 |
| 5,977,713 | A | | 11/1999 | Ochiai et al. | 315/39.51 |
| 6,204,601 | B1 | | 3/2001 | Lidstrom et al. | 315/39.51 |
| 6,362,463 | B1 | * | 3/2002 | Bessyo et al. | 219/715 |
| 6,449,178 | B1 | * | 9/2002 | Sakai et al. | 363/131 |

* cited by examiner

*Primary Examiner*—Tuyet T. Vo
(74) *Attorney, Agent, or Firm*—Staas & Halsey LLP

(57) ABSTRACT

A microwave oven includes a direct current (DC) power supply unit which supplies DC power to a magnetron so as to suppress noise induced in a high voltage line. The DC power supply unit includes at least one rectifying diode and a choke coil. The rectifying diode rectifies high frequency alternating current (AC) power generated by a heater coil into the DC power to suppress noise induced in the high voltage line of a high voltage transformer. The choke coil forms ripples in the DC power and effectively prevents a moding of the magnetron, which is generated where a constant DC voltage is supplied.

18 Claims, 4 Drawing Sheets

MICROWAVE OVEN

CROSS-REFERENCE TO RELATED APPLICATIONS

This application claims the benefit of Korean Application No. 2001-84397, filed Dec. 24, 2001, in the Korean Industrial Property Office, the disclosure of which is incorporated herein.

BACKGROUND OF THE INVENTION

1. Field of the Invention

The present invention relates to microwave ovens, and more particularly, to a microwave oven which can suppress noise induced in a high-voltage line due to a use of an inverter.

2. Description of the Related Art

Generally, a microwave oven carries out a cooking operation by converting commercial alternating current (AC) power into a high voltage to drive a magnetron. Since the microwave oven uses the commercial AC power, it is difficult to install and use the microwave oven in transportation vehicles such as cars.

Recently, a microwave oven has been developed to use direct current (DC) power, such as a battery, to cook foods. This type of microwave oven employs an inverter circuit to convert a DC voltage into an AC voltage required to drive a magnetron.

FIG. 1 shows a convention microwave oven using DC power comprising a DC power source 1, a switching unit 2, an inverter unit 3, a high voltage transformer 4, a magnetron driving unit 5 and a magnetron filter box 6.

The magnetron filter box 6 includes choke coils 8 and feed-through condensers 9 installed therein, which constitute a low pass filter, to prevent fundamental waves of 2450 MHz, harmonic waves and noise generated by the driving of a magnetron 7, from radiating to the outside.

The high voltage transformer 4 includes primary and secondary coils L1 and L2 which induce a high voltage according to their turn ratio, and a heater coil L3 which supplies an AC voltage so as to have the magnetron 7 emit thermions.

In a conventional microwave oven using AC power for a home use, power of 3.3V AC 50/60 Hz is supplied through a high voltage line connected to a heater coil, and a magnetron emits thermions without any difficulty. However, in the conventional microwave oven using the DC power shown in FIG. 1, an inverter circuit is activated to drive the magnetron 7, and a high usable frequency of 20 to 50 KHz is obtained. Accordingly, an impedance value is also high. For this reason, although AC power of 3.3V AC 50/60 Hz is supplied, it is difficult to heat the magnetron 7 to a temperature high enough to emit thermions in the conventional microwave oven using the DC power source 1.

Therefore, to drive the magnetron 7, inductance of the choke coils 8 installed in the magnetron filter box 6 is lowered to supply an AC voltage of higher than 7V AC.

However, noise is widely generated while inducing high electrical energy in a secondary side of the high voltage transformer 4 using the inverter circuit. Furthermore, this noise is radiated to the outside as the AC voltage of a high frequency (20 to 50 KHz) is supplied to the magnetron 7 through a high voltage line connecting a heater coil in the secondary side of the high voltage transformer 4 to the magnetron 7.

SUMMARY OF THE INVENTION

Accordingly, it is an object of the present invention to provide a microwave oven which supplies DC power to a magnetron, thereby enabling noise induced in a high voltage line to be suppressed.

Additional objects and advantages of the invention will be set forth in part in the description which follows, and in part, will be obvious from the description, or may be learned by practice of the invention.

To achieve the above and other objects of the present invention, there is provided a microwave oven comprising a high voltage transformer having a high voltage line, a magnetron filter box connected to the high voltage line and comprises a magnetron and a filter circuit installed therein, and a direct current (DC) power supply unit which supplies DC power to the magnetron so as to suppress noise induced in the high voltage line.

According to an aspect of the present invention, the high voltage transformer includes a secondary side which generates alternating current (AC) power, and the DC power supply unit includes a rectifying unit which rectifies the AC power into the DC power. The rectifying unit includes a plurality of rectifying diodes, each having an anode and a cathode, connected in parallel to the secondary side of the high voltage transformer, wherein the anodes are connected to a heater coil of the high voltage line and the cathodes are connected to the magnetron.

According to another aspect of the present invention, the DC power supply unit includes a choke coil which forms ripples in the DC power so as to prevent a moding of the magnetron.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENTS

Figure 1:
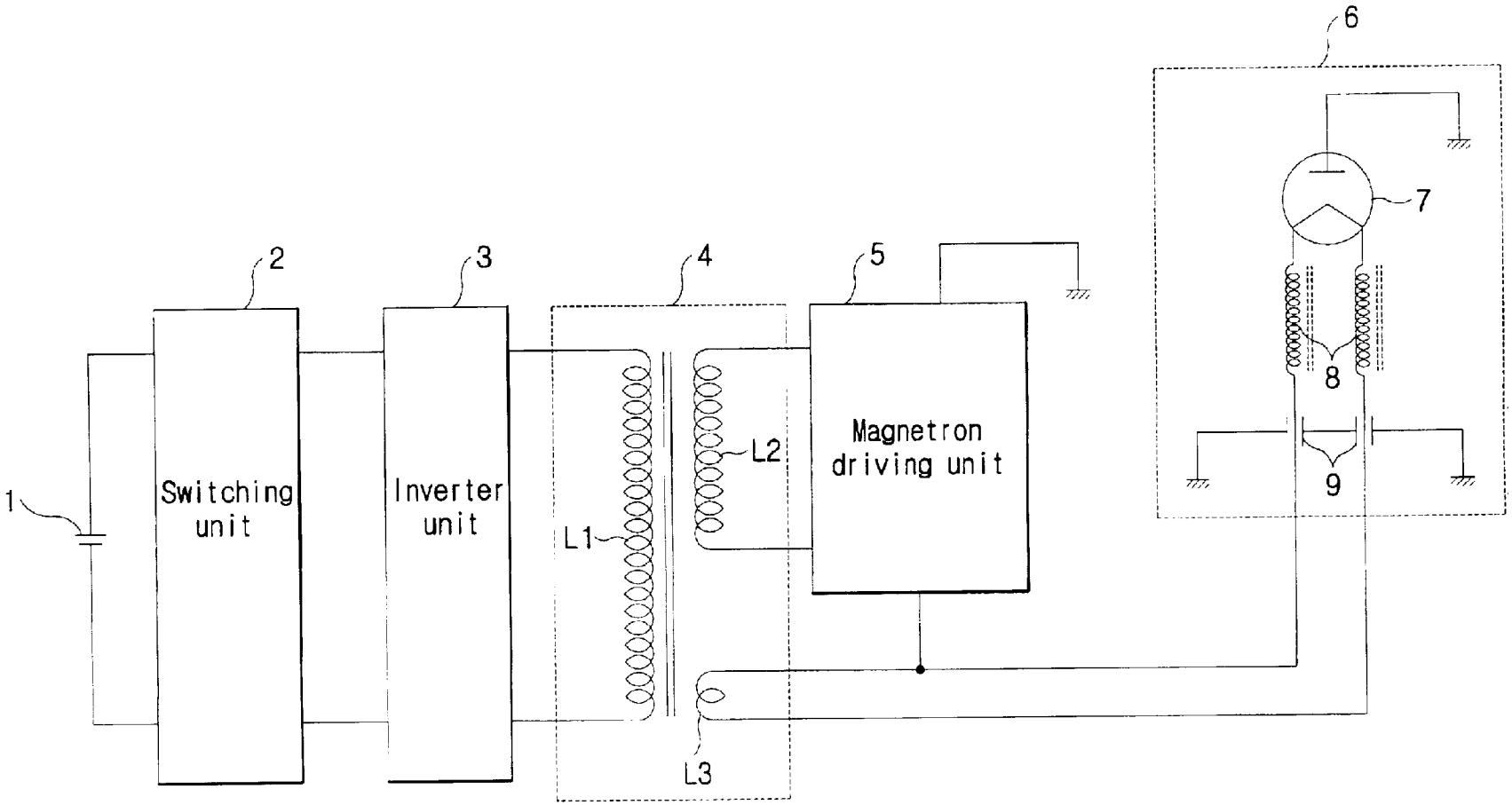
FIG. 1 (PRIOR ART)
FIG. 1 is a block diagram of a conventional microwave oven using DC power.

Reference will now be made in detail to the present preferred embodiments of the present invention, examples of which are illustrated in the accompanying drawings, wherein like reference numerals refer to like elements throughout.

The present invention can be applied to microwave ovens using AC power for a home use as well as microwave ovens using DC power as a power source. Furthermore, the present invention can be applied to microwave ovens usable with a power source selected from DC and AC power sources. For convenience and to avoid unnecessary repetition, the present invention as applied to microwave ovens using DC power is described.

Figure 2:
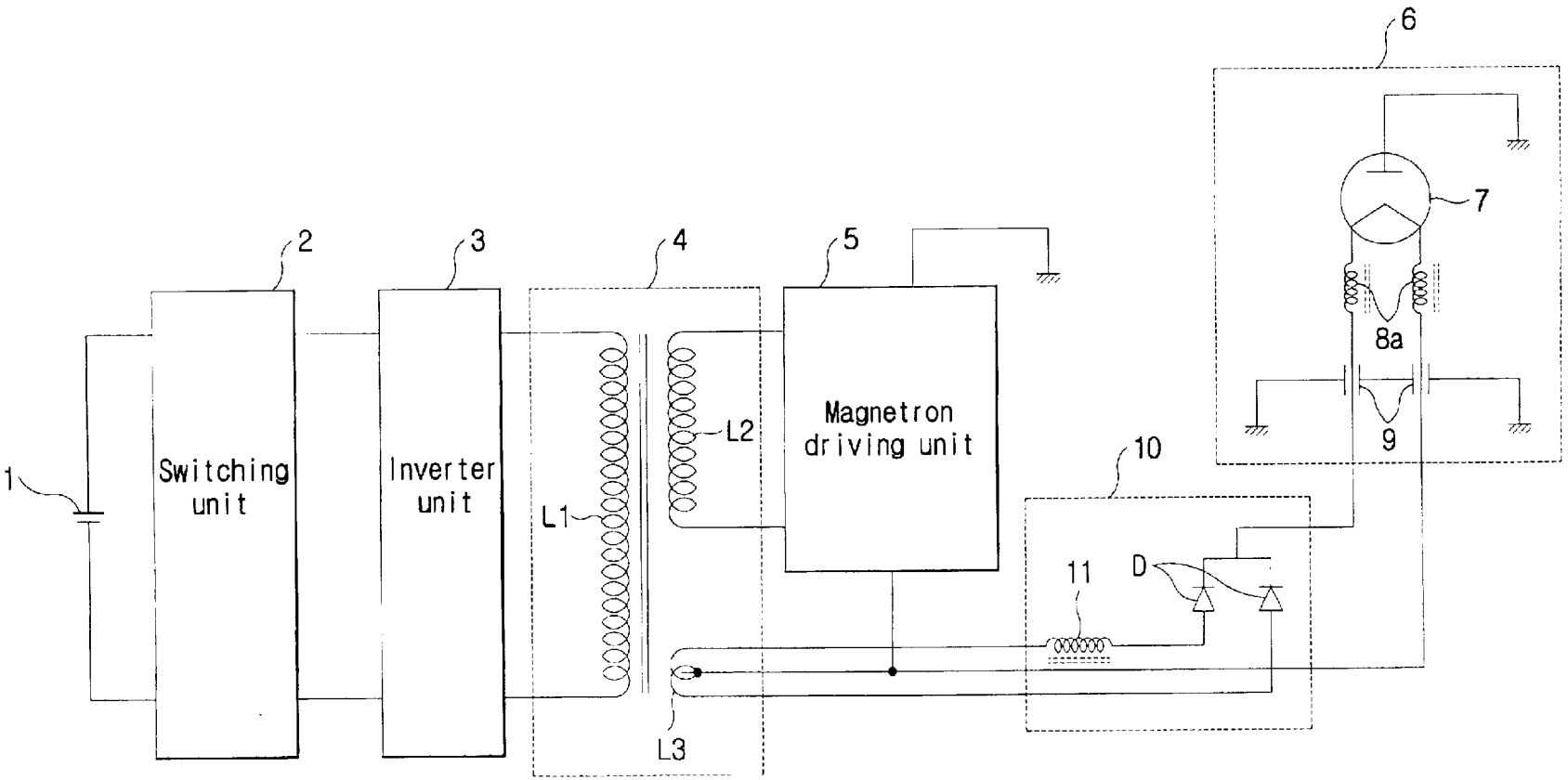
FIG. 2 is a block diagram of a microwave oven using DC power according to an embodiment of the present invention.

FIG. 2 shows a microwave oven using DC power according to an embodiment of the present invention. The microwave oven comprises a DC power source 1, a switching unit 2, an inverter unit 3, a high voltage transformer 4, a magnetron driving unit 5 and a magnetron filter box 6. The microwave oven using the DC power further comprises a DC power supply unit 10 which supplies the DC power to a magnetron 7.

The DC power source 1 includes, for example, portable batteries, and supplies DC power of 6 to 48V. The switching unit 2 includes a door switch which detects the open/shut state of a door of a cooking room and blocks the power where the door is opened, and a low voltage transformer which supplies operating power to a controller (not shown).

The inverter unit 3 comprises a push-pull circuit having switching devices, and is driven by the controller (not shown) to convert the DC power into AC power, wherein its usable frequency is higher than 20 KHz. The high voltage transformer 4 comprises primary and secondary coils L1 and L2 which induce a high voltage, and a heater coil L3 which heats the magnetron 7.

The magnetron driving unit 5 comprises a half-wave voltage doubler circuit having a high voltage condenser (not shown) and a high voltage diode (not shown), and supplies the high voltage, for example, 4000V DC generated by the secondary coil L2 and the half-wave voltage doubler circuit to the magnetron 7.

The magnetron filter box 6 includes the magnetron 7, first choke coils 8*a* and feed-through condensers 9. The first choke coils 8*a* and the feed-through condensers 9 constitute a low pass filter and perform a function of removing noise due to the driving of the magnetron 7.

The DC power supply unit 10 comprises a plurality of rectifying diodes D and a second choke coil 11. Anodes of the rectifying diodes D are connected to corresponding ends of the heater coil L3, while cathodes of the rectifying diodes D are connected to the magnetron 7 through the first choke coils 8*a*.

Figure 3:
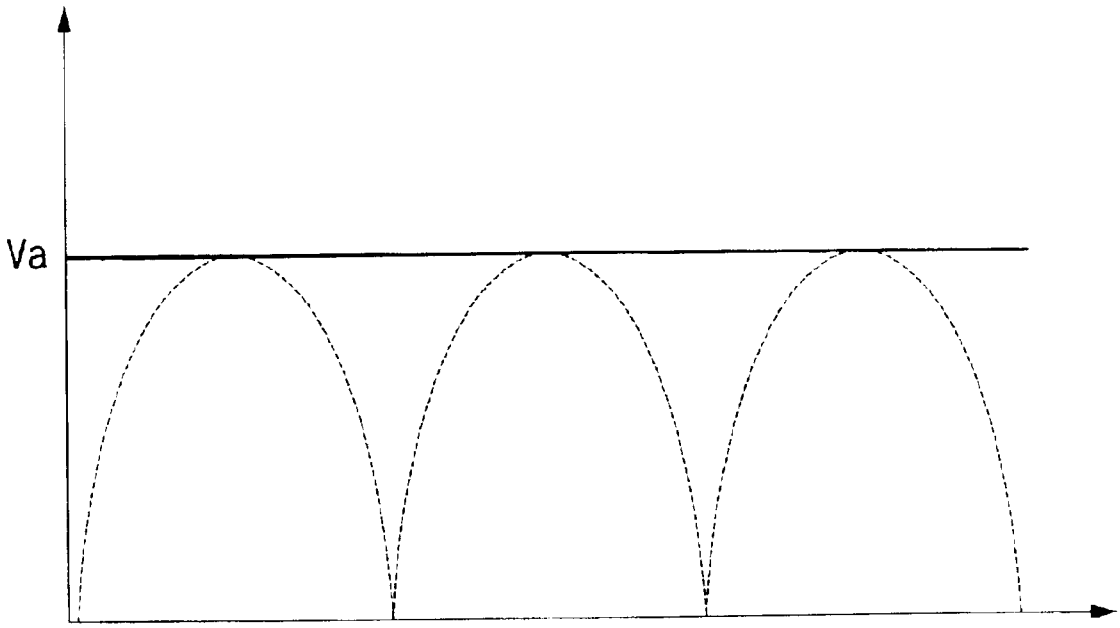
FIG. 3 is a waveform diagram of the DC power rectified by rectifying diodes of the microwave oven shown in FIG. 2.

A heater voltage is generated in the heater coil L3 by the driving of the inverter unit 3. This heater voltage is an AC voltage of high frequency, and is half-wave rectified by the rectifying diodes D to generate a half-wave rectified DC voltage Va, as shown in FIG. 3. This DC voltage is supplied to the magnetron 7, so as to have the magnetron 7 emit thermions. That is, noise of a high frequency can be fundamentally blocked because the AC voltage of the high frequency is rectified into a DC voltage by the rectifying diodes D, and then supplied to the magnetron 7.

It should be noted that a moding (mode deviation) of the magnetron 7 can occur where DC power of a constant voltage is supplied to the magnetron 7. To prevent the moding of the magnetron 7, the present invention includes the second choke coil 11 which forms ripples in the DC voltage.

Figure 4:
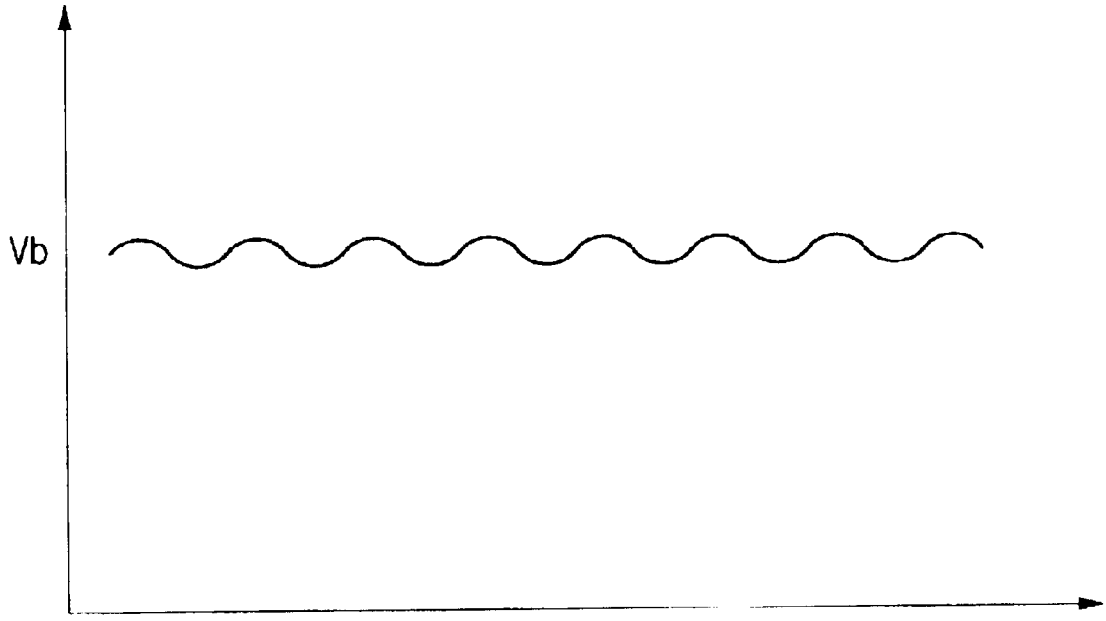
FIG. 4 is a waveform diagram of the DC power with a ripple voltage due to a choke coil of the microwave oven shown in FIG. 2.

The second choke coil 11 is connected in series between the heater coil L3 and a corresponding one of the rectifying diodes D, and allows a voltage Vb, in which ripples are formed in the rectified DC voltage as shown in FIG. 4, to be supplied to the magnetron 7. The moding of the magnetron 7 can be prevented according to the change of a phase of the voltage Vb, thereby allowing the magnetron 7 to emit thermions without difficulty.

As described above, the present invention provides a microwave oven which can suppress noise induced in a high voltage line of a high voltage transformer by supplying DC power to a magnetron, and prevent a moding of a magnetron by forming ripples in the DC power to change its phase.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a high voltage transformer having a high voltage line;

a magnetron filter box connected to the high voltage line and comprises a magnetron and a filter circuit; and a direct current (DC) power supply unit which supplies DC power to the magnetron so as to suppress noise induced in the high voltage line and comprises a rectifying unit having rectifying diodes, each comprising an anode and a cathode, connected in parallel to a secondary side of the high voltage transformer.

2. The microwave oven according to claim 1, wherein:

the secondary side of the high voltage transformer generates alternating current (AC) power; and the rectifying unit rectifies the AC power generated in the secondary side into the DC power.

3. The microwave oven according to claim 1, wherein:

the high voltage transformer further includes a heater coil; and the anodes of the rectifying diodes are connected to the heater coil of the high voltage transformer and the cathodes of the rectifying diodes are connected to the magnetron.

4. The microwave oven according to claim 1, wherein the microwave oven is a microwave oven usable with a power source selected from DC and commercial alternating current (AC) power sources.

5. The microwave oven according to claim 1, further comprising:

a switching unit which selectively blocks the DC power;

an inverter unit which converts the DC power to alternating current (AC) power; and a magnetron driving unit which supplies a high voltage to the magnetron.

6. The microwave oven according to claim 1, wherein the filter circuit comprises at least one filter choke coil and a feed-through condenser which remove driving noise due to a driving of the magnetron.

7. The microwave oven according to claim 1, wherein the DC power supply unit supplies rectified alternating current (AC) power from the high voltage transformer to the magnetron.

8. The microwave oven according to claim 7, wherein the DC power supply unit includes a choke coil which prevents a moding of the magnetron.

9. The microwave oven according to claim 7, wherein the filter circuit comprises at least one filter choke coil and a feed-through condenser which remove driving noise due to a driving of the magnetron.

10. The microwave oven according to claim 1, wherein the DC power supply unit includes a choke coil which forms ripples in the DC power so as to prevent a moding of the magnetron.

11. The microwave oven according to claim 10, wherein:

the secondary side of the high voltage transformer generates alternating current (AC) power; and the rectifying unit rectifies the AC power generated in the secondary side into the DC power.

12. The microwave oven according to claim 11, wherein:

the high voltage transformer further includes a heater coil; and the anodes of the rectifying diodes are connected to the heater coil of the high voltage transformer and the cathodes of the rectifying diodes are connected to the magnetron.

13. The microwave oven according to claim 12, wherein the choke coil is connected in series between the heater coil and a corresponding one of the rectifying diodes.

14. The microwave oven according to claim 13, wherein the filter circuit comprises at least one filter choke coil and a feed-through condenser which remove driving noise due to a driving of the magnetron.

15. The microwave oven according to claim 14, wherein the microwave oven is a microwave oven usable with a power source selected from DC and AC power sources.

16. The microwave oven according to claim 15, further comprising:

a switching unit which selectively blocks the DC power;

an inverter unit which converts the DC power to the AC power; and a magnetron driving unit which supplies a high voltage to the magnetron.

17. A microwave oven comprising:

a magnetron;

a high voltage transformer; and a direct current (DC) power supply unit, wherein the DC power supply unit supplies DC power to the magnetron so as to suppress noise induced in a high voltage line of the high voltage transformer and comprises a rectifying unit having rectifying diodes, each comprising an anode and a cathode, connected in parallel to a secondary side of the high voltage transformer.

18. The microwave oven according to claim 17, wherein the DC power supply unit includes a choke coil which prevents a moding of the magnetron.

* * * * *